US009766042B2

(12) United States Patent
Zhang et al.

(10) Patent No.: US 9,766,042 B2
(45) Date of Patent: Sep. 19, 2017

(54) INTEGRATED PRECISE PHOTOELECTRIC SIGHTING SYSTEM

(71) Applicant: Huntercraft Limited, Albany, NY (US)

(72) Inventors: Lin Zhang, Albany, NY (US); Chunhua Shi, Albany, NY (US); Sang Su, Albany, NY (US)

(73) Assignee: HUNTERCRAFT LIMITED, Albany, NY (US)

( * ) Notice: Subject to any disclaimer, the term of this patent is extended or adjusted under 35 U.S.C. 154(b) by 0 days.

(21) Appl. No.: 15/203,504

(22) Filed: Jul. 6, 2016

(65) Prior Publication Data

US 2017/0115096 A1 Apr. 27, 2017

Related U.S. Application Data

(63) Continuation-in-part of application No. 14/922,642, filed on Oct. 26, 2015, now Pat. No. 9,410,769.

(51) Int. Cl.

| | |
|---|---|
| ***F41G 1/38*** | (2006.01) |
| ***F41G 3/16*** | (2006.01) |
| ***F41G 3/08*** | (2006.01) |
| ***F41G 1/54*** | (2006.01) |

(52) U.S. Cl.

CPC ..... *F41G 3/165* (2013.01); *F41G 1/38* (2013.01); *F41G 1/54* (2013.01); *F41G 3/08* (2013.01)

(58) Field of Classification Search

CPC ... F41G 1/38; F41G 1/473; F41G 1/00; F41G 3/06; F41G 3/08

USPC ..... 42/111–148

See application file for complete search history.

(56) References Cited

U.S. PATENT DOCUMENTS

| | | | | |
|---|---|---|---|---|
| 5,026,158 | A * | 6/1991 | Golubic | F41G 1/38 356/252 |
| 8,047,118 | B1 * | 11/2011 | Teetzel | F41G 1/473 235/414 |
| 8,100,044 | B1 * | 1/2012 | Teetzel | F41G 1/473 235/414 |
| 8,561,518 | B2 * | 10/2013 | Teetzel | F41G 1/473 235/414 |
| 8,833,231 | B1 * | 9/2014 | Venema | F41G 3/16 89/204 |

(Continued)

*Primary Examiner* — Samir Abdosh

(74) *Attorney, Agent, or Firm* — Novick, Kim & Lee, PLLC; Allen Xue

(57) ABSTRACT

The invention discloses an integrated precise photoelectric sighting system that facilitates calibration, the system comprises a field-of-view obtaining unit, a range-finding unit, a display unit, three-dimension unit and a sighting circuit unit; In the sighting system, an optical image obtained by the field-of-view obtaining unit can be displayed on the display unit, which simultaneously displays the optical image, an icon and a reticle, wherein the icon is used to indicate the adjustment of the optical image, and the reticle is used to aim the target in the optical image. The three-dimension unit can convert the reticle, the icon and the image information obtained by the field-of-view obtaining unit, which are displayed by the display unit, from a two-dimension image into a three-dimension image, thereby allowing user to perceive deeply the environment. The precise photoelectric sighting system applies the sighting circuit unit and the range-finding unit to perform precise prediction to the impact point.

21 Claims, 11 Drawing Sheets

(56) References Cited

U.S. PATENT DOCUMENTS

| | | | | |
|---|---|---|---|---|
| 2003/0140775 | A1* | 7/2003 | Stewart | F41G 3/06<br>89/41.05 |
| 2006/0137235 | A1* | 6/2006 | Florence | F41G 1/32<br>42/132 |
| 2007/0209268 | A1* | 9/2007 | Birurakis | F41G 1/473<br>42/119 |
| 2008/0000134 | A1* | 1/2008 | Peterson | F41C 23/16<br>42/124 |
| 2008/0060248 | A1* | 3/2008 | Pine | F41G 1/35<br>42/114 |
| 2010/0128110 | A1* | 5/2010 | Mavromatis | G06T 7/292<br>348/47 |
| 2012/0043381 | A1* | 2/2012 | Teetzel | F41G 1/473<br>235/404 |
| 2013/0174464 | A1* | 7/2013 | Chung | F41G 1/35<br>42/113 |
| 2014/0251123 | A1* | 9/2014 | Venema | F41G 3/16<br>89/41.22 |

* cited by examiner

INTEGRATED PRECISE PHOTOELECTRIC SIGHTING SYSTEM

FIELD OF THE INVENTION

The present invention relates to the technical field of gun sight, and more specifically relates to an integrated precise photoelectric sighting system that facilitates calibration.

BACKGROUND OF THE INVENTION

Traditional sights usually include mechanical sights and optical sights, wherein the mechanical sights generally refer to performing sighting mechanically through a metallic sight such as a rear sight, a front sight, and a notch; the optical sights refer to imaging with optical lens, where a target image and a line of sight are superimposed on a same focal plane, such that a point of sighting will not be affected even with slight eye offset.

During a shooting process, the two traditional sights need to calibrate reticle and an impact point repeatedly so as to make the impact point in coincidence with a reticle center. During the process of calibrating the impact point in coincidence with the reticle center, it is required to tune a rotary knob or perform other mechanical adjustment. After long-term use, either the rotary knob or other mechanical adjustments will cause abrasive wear or offset to the machine, resulting in offset. However, long-range shoot sighting is extremely demanding on preciseness. In long-range shooting, a minor error in a gun or sight will cause great deviation in a shooting result. This brings extreme inconvenience in practical application.

In aiming a target by using those two types of conventional gunsights, when the target is moving, a shooter needs to highly focus on the display device for a long time, or needs to observe and trace the target without the gunsight. However, in practice, it is difficult for a non-professional person to highly focus on the display device or observe and trace the target for a long time. In addition, observing and tracing the target without the gunsight or by using other devices causes great inconvenience for the shooter in the aspects of operation and shooting experience.

After the above two traditional sights have been calibrated for sight shooting, an exact shooting can only be accomplished with a correct sighting posture in conjunction with a long-term shooting experience, but for a starter in shooting, the sighting posture and not so much experience in shooting will affect the preciseness of the shooting.

Meanwhile, a traditional shooting requires a user to sight with one eye, while the other eye should be closed, so as to prevent two eyes from capturing different images, which affects the shooting. However, in the case of single-eye sighting, it is inconvenient for the user to watch what happens around. Sudden change of the environment will inevitably affect the shooting. Therefore, if dual-eye sighting can be implemented during the sighting process, the user's shooting operation will become simpler and easier.

In view of the above situation, if two types of display devices are provided for sighting and the display mode can be freely switched according to environment and user needs, the shooting operation of the user will become more convenient and effective.

When the conventional gunsight is used, the display device displays a two-dimension plane image, which lacks a three-dimension image effect in the aspects of shooting process, shooting environment, target change, etc., causing absence of immersive feeling of reality. It appears difficult for the conventional gunsight to search target and sight an object, usually after an object is finally sighted, it is difficult to be again sighted due to shaking or target movement. Therefore, if the three-dimension image effect is realized during the process of sighting, the user will have a more impressive feel and experience.

SUMMARY OF THE INVENTION

In view of the above problems present in the prior art, the present invention provides a precise photoelectric sighting system, which allows for simple shooting calibration, quick and accurate sighting, man-machine interaction, two-eye sighting, switching of display modes, a three-dimension image effect, and target tracing.

The present invention provides an integrated precise photoelectric sighting system that facilitates calibration, the system comprising a housing that defines an accommodation space, the accommodation space including a field-of-view obtaining unit, a range-finding unit, a display unit, three-dimension unit and a sighting circuit unit, the sighting system being capable of displaying an optical image obtained by the field-of-view obtaining unit on the display unit and precisely predicting an impact point, thereby facilitating the user to calibrate and shoot.

Further, an entirety of the housing is of a detachable structure;

Further, the field-of-view obtaining unit and the rang-finding unit are fixed within the accommodation space of the housing, the rang-finding unit comprising a signal emitting end and a signal receiving end, the field-of-view obtaining unit comprising an optical image obtaining end, all of the signal emitting end, the signal receiving end, and the optical image obtaining end being disposed at a front end of the housing, the signal emitting end and the signal receiving end are symmetrically distributed at an upper side of the optical image obtaining end, a plane formed by the optical image obtaining end being angled with a vertical side of a gun.

Further, both the signal emitting end and the signal receiving end project above the optical image obtaining end.

Further, the signal emitting end and the signal receiving end are disposed at an upper end or a lower end of the optical image obtaining end.

Further, the front end of the housing is also provided with a protection unit.

Further, the photoelectric sighting system further comprises three field-of-view regulating units (which are key on the display unit, key provided on the housing and key connected to the housing, respectively).

Further, at a rear end of the housing is provided the display unit, the display unit comprises an eye lens module, a display screen module, and a state monitoring module for monitoring a position state of the display screen module at any time; the display unit is configured to switch a display mode according to a state of the display screen module, and the display screen module allows for two-eye observing and sighting, wherein the display unit is disposed at a rear end of the housing, with the eye lens module being disposed at the rearmost end of the housing and the display screen module being disposed on any side of the rear end of the housing.

Further, within the accommodation space of the hosing are provided the sighting circuit unit and a battery assembly (power supply), the field-of-view obtaining unit and the display unit being connected through the sighting circuit unit, the sighting circuit unit comprising a sensor assembly, the sensor assembly comprising a plurality of sensors that may be an acceleration sensor, a wind speed wind direction sensor, a geomagnetic sensor, a temperature sensor, a barometric sensor, a humidity sensor, a vibration sensor, a position monitoring sensor and among others; the state monitoring module monitoring the position state of the display screen module, and transmitting the monitored result to the sighting circuit unit; and the battery assembly supplying power to power units within the photoelectric sighting system.

Further, at a rear end of the housing is also provided the three-dimension unit, the three-dimension unit configured to convert the reticle, the icon and the image information obtained by the field-of-view obtaining unit, which are displayed on the display unit, from a two-dimension image into a three-dimension image.

Further, the sighting circuit unit comprises a interface board and a processing board, where a field-of-view driving circuit of the field-of-view obtaining unit, a ranging control circuit in the range-finding unit, a key control circuit in the key unit, and a battery control circuit of the battery assembly are all connected onto the processing board through the interface board, and a display driving circuit of the display unit and a WiFi driving circuit of the wireless transmission module are connected to the core board.

Further, the processing board is provided thereon with two ballistic models suitable for the photoelectric sighting system of the present invention and one ballistic model selecting unit, where the ballistic model selecting unit may manually or automatically select a ballistic model; wherein one ballistic model adopts less sensor information and performs ballistic simulation in conjunction with basic information of a bullet, while the other ballistic model adopts more sensor information to perform ballistic simulation.

Further, in order to realize accurate shooting, the present invention further provides a calibration method for realizing accurate shooting during a shooting process of an photoelectric sighting system, the calibration method being applied to the photoelectric system in the above embodiments, the calibration method comprising: setting a target within a field of view of the photoelectric sighting system, and measuring a distance from the photoelectric sighting system to the target through a range-finding unit of the photoelectric sighting system; invoking a plane coordinate via a key unit so as to load onto the display unit, and applying a coordinate center to sight; viewing the field of view of the display unit, controlling a gun, aligning the coordinate center with the target; upon alignment, shooting a first bullet, and obtaining a first impact point on the target, the display unit print-screening an image having the first impact point; and adjusting the field of view of a display screen of the photoelectric sighting system, such that a center of the plane coordinate coincides with the first impact point; accomplishing the calibration.

Further, the precise photoelectric sighting system may also possibly comprise adding a simulated calibration prior to a first shooting calibration, the simulated calibration simulating an impact point through the ballistic models.

Further, the precise photoelectric sighting system may further comprise adding a second shooting calibration after the first shooting calibration, so as to enhance the preciseness of calibration.

Further, in the case that the precise photoelectric sighting system which allows for easy calibration is used, the following steps are performed: installing a light-emitting device in a gun installed with the sighting system; placing a reflection plate at a certain distance ahead of the gun; emitting a beam of light from the gun bore, with the light being transmitted to the reflection plate and then reflected to the photoelectric sighting system; automatically capturing the reflected light by the optical sensor assembly in the photoelectric sighting system, encoding the information of the light into optical data, and transmitting the optical data to the processor by the sighting circuit unit; processing the optical data by the processor, and transmitting the processed optical data to the display unit; displaying a light spot corresponding to the reflection plate on the display unit; performs image recognition processing on the light spot displayed by the display unit by the sighting circuit unit in the photoelectric sighting system, calculating a position data of the light spot, and further calculating offset data of the position data of the light spot relative to a center of the reticle on the display unit; and automatically performing image offset processing by the sighting circuit unit according to the offset data, and recording an offset value; and accomplishing automatic calibration.

Further, in the photoelectric sighting system, the light-emitting device may be a laser calibrator or an LED calibrator, but not limited thereto; and the light emitted by the light-emitting device comprises visible light or invisible light.

Further, in the photoelectric sighting system, the reflection plate may reflect the visible light or invisible light emitted by the light-emitting device.

Further, in the photoelectric sighting system, the position data of the light spot comprises horizontal coordinate data and longitudinal coordinate data.

Further, in the photoelectric sighting system, during the processes of image offset processing and offset value calculation, a fixed physical height difference for mechanical part installation may be used.

Further, in the precise photoelectric sighting system allowing for easy calibration, when performing sighting and locking operations on a target before shooting, the photoelectric sighting system obtains a real impact point at the current distance and a distance between the real impact point and a target marked point according to a calculation result of a built-in ballistic equation, here, the target marked point is set manually or automatically by the photoelectric sighting system to be a fatal point of a target prey, such as neck or heart.

The photoelectric sighting system displays the real impact point on the display unit, and obtains real offset pixels from the real impact point to the reticle. Because the reticle is located at the center of the screen, according to the direction of the offset pixels, the image is shifted in a direction opposite to the direction of the offset pixels in aligning the real impact point with the reticle.

When the ballistic calculation result indicates that there is a relatively significant distance between the real impact point and the target marked point, the shifted image might exceed the display region of the display unit, and under this condition, the photoelectric sighting system performs the locking operation on the fatal point of the target, and an indication frame for indicating an offset direction and an offset distance for shooting is popped up at the bottom right corner of the display region, so that the user may adjusting the shooting direction according to the offset direction and the offset distance in the indication frame, where the offset direction and the offset distance in the indication frame will be updated in real time according to the movement of the image during the adjustment. When the offset distance is smaller than a threshold value, the offset direction and the offset distance in the indication frame are set to zero.

Further, in the photoelectric sighting system, the borders of the indication frame, the icon of the offset direction and the shape, color and size of the icon in the indication frame may be selectively set by the user.

In conjunction with the accompanying drawings, features of the present invention will be described in more detail in the following detailed depiction of various embodiments of the present invention.

BRIEF DESCRIPTION OF THE ACCOMPANYING DRAWINGS

Figure 20:
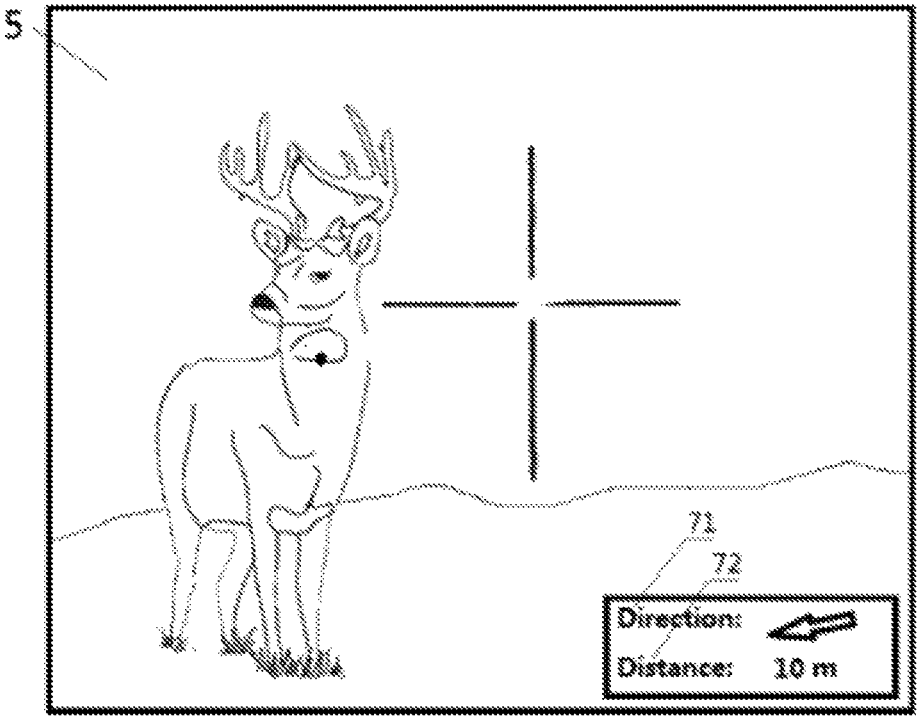
Figure 21:
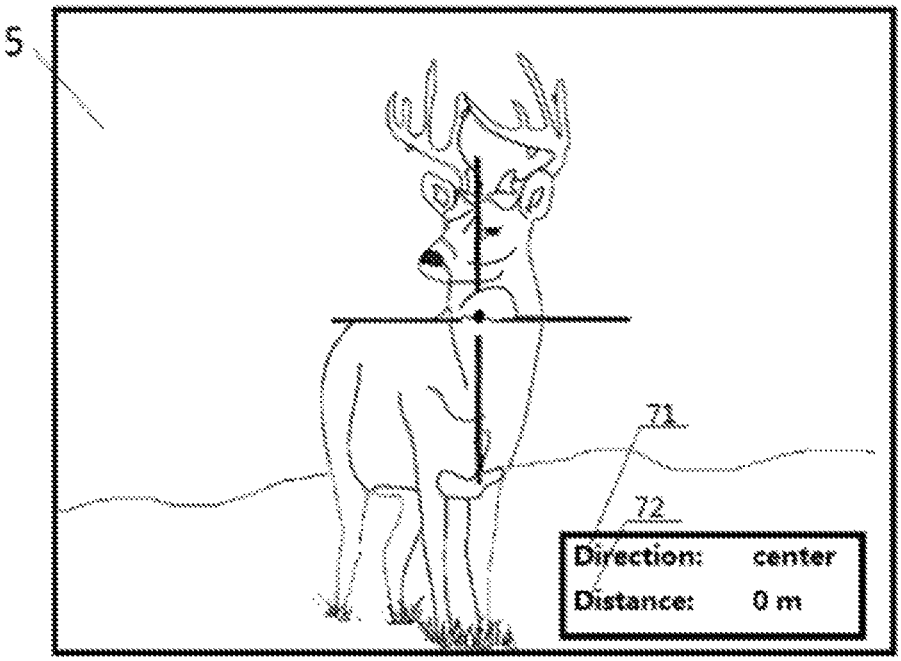

FIG. 20 is a schematic diagram showing the display screen at an offset state in an offset prompting method of the photoelectric sighting system according to an embodiment of the present invention; and FIG. 21 is a schematic diagram showing the display screen after the offset state has been regulated in the offset prompting method of the photoelectric sighting system according to an embodiment of the present invention.

DETAILED DESCRIPTION OF THE PREFERRED EMBODIMENTS

In order to make the objective, technical solution, and advantages of the present invention more elucidated, the present invention will be described in more detail with reference to the accompanying drawings and embodiments. It should be understood that the preferred embodiments described here are only for explaining the present invention, not for limiting the present invention.

On the contrary, the present invention covers any replacements, modifications, equivalent methods and solutions defined by the claims within the spirit and scope of the present invention. Further, in order to make the public understand better the present invention, some specific detailed portions are elaborated in the following depiction of the details of the present invention.

The present invention proposes an integrated precise electro-optic sighting system that facilitates calibration. The photoelectric sighting system may be mounted on various kinds of sporting guns, e.g., riffles, etc. The photoelectric sighting system may also be mounted on a pistol, air gun, or other small-sized guns. By an installer, the photoelectric sighting system according to the present invention may be securely and stably mounted on a mount rail or an accommodation device of the gun. The installer is a technology of a known kind, and the installer employed in the present invention is suitable for mount rails or accommodation devices for various kinds of guns. Specifically, the installer may be adapted to different mount rails or accommodation devices through a regulating mechanism on its own. After the mounting is completed, the photoelectric sighting system and the gun are calibrated by applying the calibration method or calibration apparatus for the gun and the gun sight.

Figure 1:
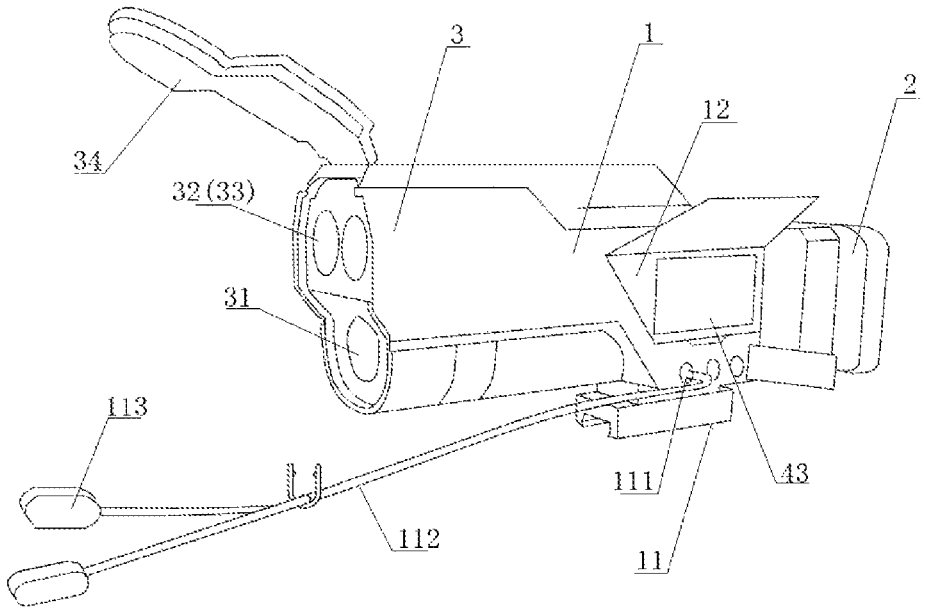
FIG. 1 shows a structural diagram of an appearance of a photoelectric sighting system in an embodiment of the present invention.
Figure 2:
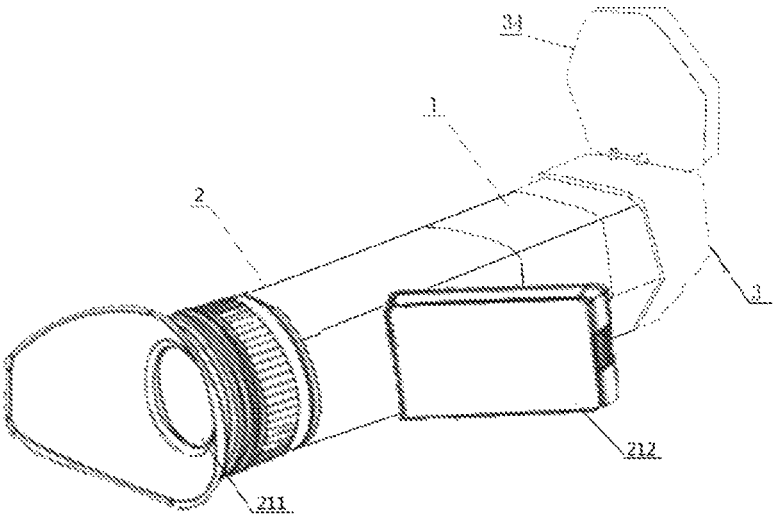
FIG. 2 shows a structural diagram of another appearance of a photoelectric sighting system in an embodiment of the present invention.
Figure 3:
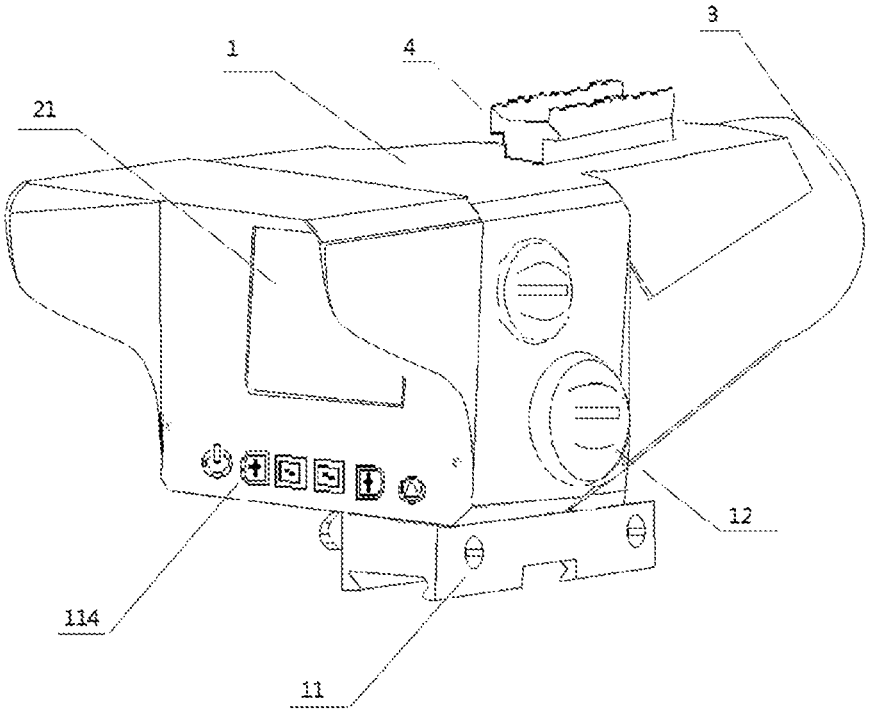
FIG. 3 shows a structural diagram of another appearance of a photoelectric sighting system in an embodiment of the present invention.

FIG. 1 shows an external structural diagram of a photoelectric sighting system in an embodiment of the present invention; FIG. 2 shows another external structural diagram of a photoelectric sighting system in an embodiment of the present invention. FIG. 3 shows a structural diagram of another appearance of a photoelectric sighting system in an embodiment of the present invention. FIGS. 1, 2 and 3 embody various aspects of the photoelectric sighting system according to the present invention. The photoelectric sighting system comprises a housing 1, the housing 1 deciding a size of the photoelectric sighting system and a size of an internal circuit of the housing 1, the housing 1 defining an internal space accommodating a field-of-view obtaining unit 31, a display unit 21, and even more elements; meanwhile, the display unit 21 includes an eye lens module 211, a display screen module 212, and a state monitoring module 213. The housing 1 includes an auxiliary installation guide rail 4, which is located on the upper part of the housing 1 and is used for installing an infrared laser range-finder, a laser controller and other auxiliary devices; meanwhile, the housing 1 comprising a housing front end 3 and a housing rear end 2, where the field-of-view obtaining unit 31 is mounted at the front end portion, while a field-of-view obtaining end of the field-of-view obtaining unit 31 is disposed at an internal side of the housing front end 3. The field-of-view obtaining unit 31 is used for collecting video information within the field of view. The display unit 21 is mounted at the housing rear end. The display unit 21 at least may simultaneously display the video information collected by the field-of-view obtaining unit 31 and the reticle for sighting; the video information collected by the field-of-view obtaining unit 31 is transmitted to the display unit through a sighting circuit unit disposed within the housing.

In one embodiment, the display unit 21 includes an eye lens module 211, a display screen module 212, and a state monitoring module 213. The eye lens module 211 employs a silicon-based liquid crystal display, but is not limited thereto. The display screen module 212 employs an LCD display screen, but is not limited thereto. The state monitoring module 213 includes a position monitoring sensor 214, which is configured to monitor a position state of the display screen module 212 and transmit monitored data to a processor on a CPU core board 41. The state of the display screen module 212 includes an unfolded state and a folded state. A rotation module, though which the display screen module 212 is unfolded or folded, is arranged on the rear end 2 of the housing of the photoelectric sighting system. In the present invention, the display screen module 212 is located on the left side of the rear end 2 of the housing, and the display screen module 212 can be unfolded at any angle in a range from 0° to 90° relative to the rear end 2 of the housing, but is not limited to the illustrated position and angle.

The processor on the CPU core board 41 is internally provided with a dual-channel output module, which is configured for dual-channel outputs including an output to the eye lens module 211 and an output to the display screen module 212. In order to adapt to different shooting environments and shooting habits, the photoelectric sighting system is set to be switchable between these two output modes of the switching eye lens module 211 and the display screen module 212. The eye lens module is used for a one-eye observation and sighting mode, and the display screen module is used for a two-eye observation and sighting mode.

The display mode of the display unit 21 includes: a mode of displaying by the eye lens module 211 alone, a mode of displaying by the display screen module 212 alone, and a mode of displaying by both the eye lens module 211 and the display screen module 212 simultaneously. When the eye lens module 211 is used, the processor opens the output channel for the eye lens module, and monitors the state of the display screen module 212 by means of the position monitoring sensor 214 in the state monitoring module 213; when the display screen module 212 is used, the processor opens the output channel for the display screen; and when the eye lens module 211 and the display screen module 212 are used together, the processor simultaneously opens the output channel for the eye lens module and the output channel for the display screen module.

The switching of the display mode of the display unit 21 is set so that, in the photoelectric sighting system, the eye lens module 211 is in an opened state by default, and the open or closed state of the display screen module 212 needs to be confirmed by the processor according to the monitoring result. If the eye lens module 211 and the display screen module 212 are simultaneously in an opened state, the user can set the eye lens module 211 into a closed state or set the display screen module 212 into a closed state by software, but cannot simultaneously set both the eye lens module 211 and the display screen module 212 into the closed state.

The present invention adopts a structure having a housing front end and a housing rear end; besides, the housing front end and the housing rear end may realize an individual replacement. When a part of the photoelectric sighting system is damaged, it may be replaced according to the space and housing part where it is located, such that the photoelectric sighting system can be repaired; or, it may be dismounted according to the space and housing part where it is located so as to replace the damaged part individually, thereby realizing repair of the photoelectric sighting system.

In other embodiments, the display unit 21 may simultaneously display the view information collected by the field-of-view obtaining unit 31, the reticle for sighting, information for shooting assistance, and functional information; the information for shooting assistance includes: distance information, horizontal angle information, vertical elevation information, and the like, obtained by a sensor, and the functional information includes function menu, zoom regulation, battery level, and remaining video time, etc.

The field-of-view obtaining unit 31 comprises a object lens (or combination of object lens) or other optical visual device having an amplification function; the optical visual device or the object lens having an amplification function are mounted at a front end of the field-of-view obtaining unit 31 so as to increase the amplification ratio of the field-of-view obtaining unit;

The entirety of the electrical-optical sighting system may be a digitalized device, which may communicate with a smart phone, an intelligent terminal, a sighting module or circuit, and send the video information collected by the field-of-view obtaining unit 31 to the smart phone, intelligent terminal, sighting module or circuit, and display the video information collected by the field-of-view obtaining unit 31 through devices like the smart phone and the intelligent terminal.

In one embodiment, the field-of-view obtaining unit 31 can be a video camera. The lens zoom multiple of the field-of-view obtaining unit can be selectively varied based on actual applications; the video camera as employed in the present invention is 3-18× video camera made by Sony, but not limited to the above model and zoom multiple. The video camera is disposed at the foremost end of the photoelectric sighting system; meanwhile the front end of the camera is equipped with a UV lens and a lens cap 34. The lens cap 34 may perform a 270° flip to fully cover the front end of the housing, which protects the field-of-view obtaining unit from not being hurt, protects the lens and facilitates cleaning.

Figure 4:
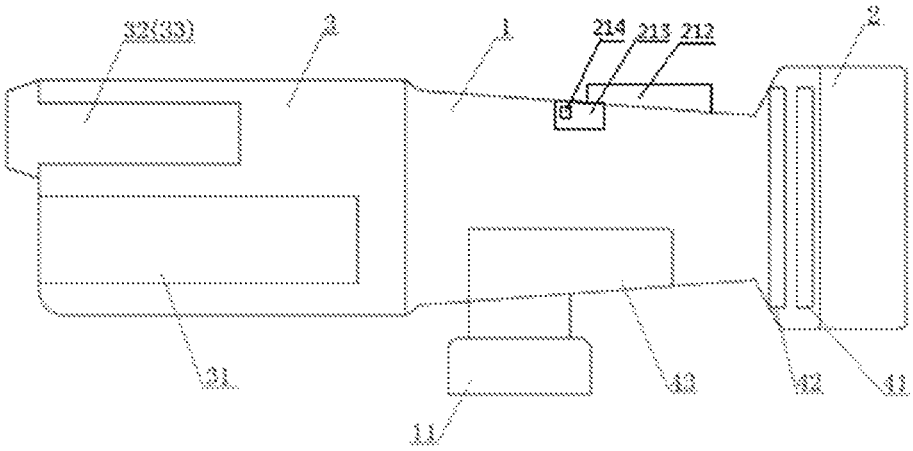
FIG. 4 shows a structural sectional view of a photoelectric sighting system in an embodiment of the present invention.

As shown in FIGS. 2 and 4 in the above embodiment, the photoelectric sighting system comprises a range-finder that is a laser range-finder. The range-finder is located within the housing 1. The laser range-finder is a pulse-type laser range-finder. The ranging principle of the pulse-type laser range-finder is first finding the time needed for a round trip of the laser as to the to-be-measured distance, and then calculating the to-be-measured distance through the following equation using this time:

$$L = \frac{ct}{2}$$

In the expression, L denotes the to-be-measured distance, c denotes a light velocity, while t denotes flying time of the laser.

Figure 5:
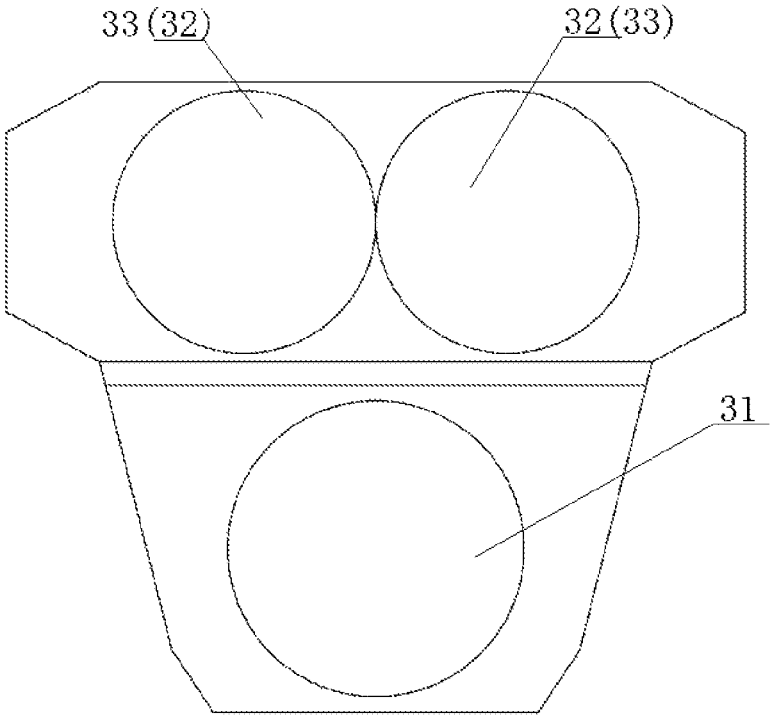
FIG. 5 shows a diagram of a front end of a housing of a photoelectric sighting system in an embodiment of the present invention.

As shown in FIG. 5, the laser range-finder comprises a laser emitting end 32 and a laser receiving end 33. Both the laser emitting end 32 and laser receiving end 33 are disposed at a front end of the housing 1 and symmetrically distributed above the camera of the video camera. The laser emitting end 32, laser receiving end 33, and the camera of the video camera form an equilateral inverted triangle or an isosceles inverted triangle. Both the laser emitting end 32 and the laser receiving end 33 project above the front end of the housing 1, and the laser emitting end 32 and the laser receiving end 33 have a certain height difference over the field-of-view obtaining unit 31; moreover, the laser emitting end 32 and the laser receiving end 33 project above the housing front end 3. Such design narrows the housing internal space occupied by the laser range-finder. By projecting the extra-long portions of the laser emitting end 32 and the laser receiving end 33 outside of the housing front end 3, a high integration of the internal space of housing 1 is realized, such that the electrical-optic sighting system becomes more miniaturized, more flexible, and more portable; additionally, because the thickness of the object lens of a common field-of-view obtaining unit is higher than the thickness of the lens of the laser emitting end and receiving end, this design may reduce the laser range-finding error.

The lens cap 34 as mentioned in the above embodiment may cover the field-of-view obtaining unit as well as the front end of the laser range-finder, so as to protect the laser range-finder from being damaged.

The laser emitting end 32 has a laser source therein. Under the control of a photoelectric sighting system control means or a core board, the laser source emits one or more laser beam pulses within the field-of-view of the photoelectric sighting system; the laser receiving end 33 receives a reflective beam of one or more laser beam pulses, and transmits it to the control means or core board of the photoelectric sighting system; the laser emitted by the laser emitting end 32 is received by the laser receiving end 33 after being reflected by the measured object. The laser range-finder simultaneously record the round-trip time of the laser beam pulse. A half of a product of the light velocity and round-trip time is the distance between the range-finder and the measured object.

In one embodiment, the laser range-finder may also comprise a gate control circuit unit, a counting unit, and a laser range-finding control unit, the laser emitting end 32 comprises a drive circuit of a drive emission pulse laser. The laser receiving end 33 comprises a photoelectric detector, a photoelectric converting unit, and a shaping amplification circuit; the laser range-finding control unit is connected to the drive circuit, and the photoelectric detector, the photoelectric converting circuit, and the shaping amplification circuit are connected in succession, and the shaping amplification circuit is further connected to the counting unit through the gate control circuit unit; the laser range-finding control unit is also connected to the gate control circuit unit and the drive circuit. The counting unit comprises a counter and a reference lock. The counter is connected to the gate control circuit unit. The counter outputs a range-finding result, and transmits the range-finding result to the control device of the photoelectric sighting system.

The laser range-finder according to the embodiments of the present invention adopts a semiconductor laser with a work wavelength of 905 nanometer or 1540 nanometer. First, it avoids damage to the human body by the laser; meanwhile, the photoelectric detector can accurately determine the start and end points of the laser pulse and accurately measure the flying time of the laser. By controlling the frequency of the reference clock pulse above 1.5 GHz, error will be reduced.

The sighting circuit unit disposed within the housing 1 for connecting the field-of-view obtaining unit 31 and the display unit 21 comprises a CPU core board 41 and an interface board 42. The interface board 42 is connected to the CPU core board 41. Specifically, the input and output of the CPU core board 41 are connected through a serial port at a bottom side of the interface board 42, and the CPU core board 41 is disposed at one side of the display unit 21 display screen relative to the inside of the housing 1. The interface board 42 is disposed at one side of the CPU core board 41 opposite to the display screen. The display screen, CPU core board 41, and the interface board 42 are disposed parallel to each other. The video camera and the range-finder are connected to the interface board 42 through a wiring. The image information obtained by the video camera and the distance information obtained by the range-finder are transmitted to the CPU core board 41 through the socket board 42, and then the information is displayed on the display screen via the CPU core board 41.

The CPU core board 41 may be connected to a memory card via the interface board 42 or directly connected to the memory card. In the embodiments of the present invention, a memory card slot is provided at a top position of the CPU core board 41. The memory card is plugged into the memory card slot. The memory card may store information. The stored information may be provided to the CPU core board 41 for calculation of a ballistic equation. The memory card may also store feedback information transmitted by the CPU core board 41.

A USB interface is also provided at the memory card slot edge side at the top of the CPU core board 41. Through the USB interface, information from the CPU core board 41 may be outputted, or the software program disposed within the CPU core board 41 may be upgraded and optimized.

Figure 6:
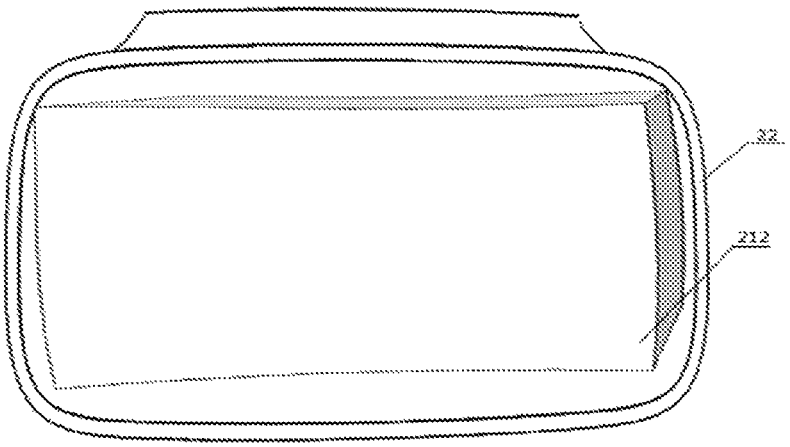
FIG. 6 shows a work diagram of a three-dimension unit of an electrical-optical sighting system in an embodiment of the present invention.

As shown in FIG. 6, the photoelectric sighting system includes a three-dimension unit 22, which is connected with the housing and arranged outside of the display unit 21, and may be dismounted or mounted according to user needs.

The three-dimension unit includes a virtual display module, which can form a three-dimension space and construct the image in the field-of-view in the display unit 21 into a three-dimension model environment.

The three-dimension unit 22 includes a focal length adjusting knob, a visual distance adjusting knob, and an object distance adjusting knob. The focal length adjusting knob can be automatically regulated to achieve the optimum clearest effect according to an image in the display region; the visual distance adjusting knob provides the user with different visual distances adapted to different shooting postures of the user, and may be manually and slightly regulated depending on user habits; and the object distance adjusting knob is regulated to an appropriate position according to the relative position of the display unit 21 and the three-dimension unit 22, in order to obtain a better visual experience, here, the object distance adjusting knob may be manually and slightly regulated depending on an installation position and user's viewing habits.

Figure 7:
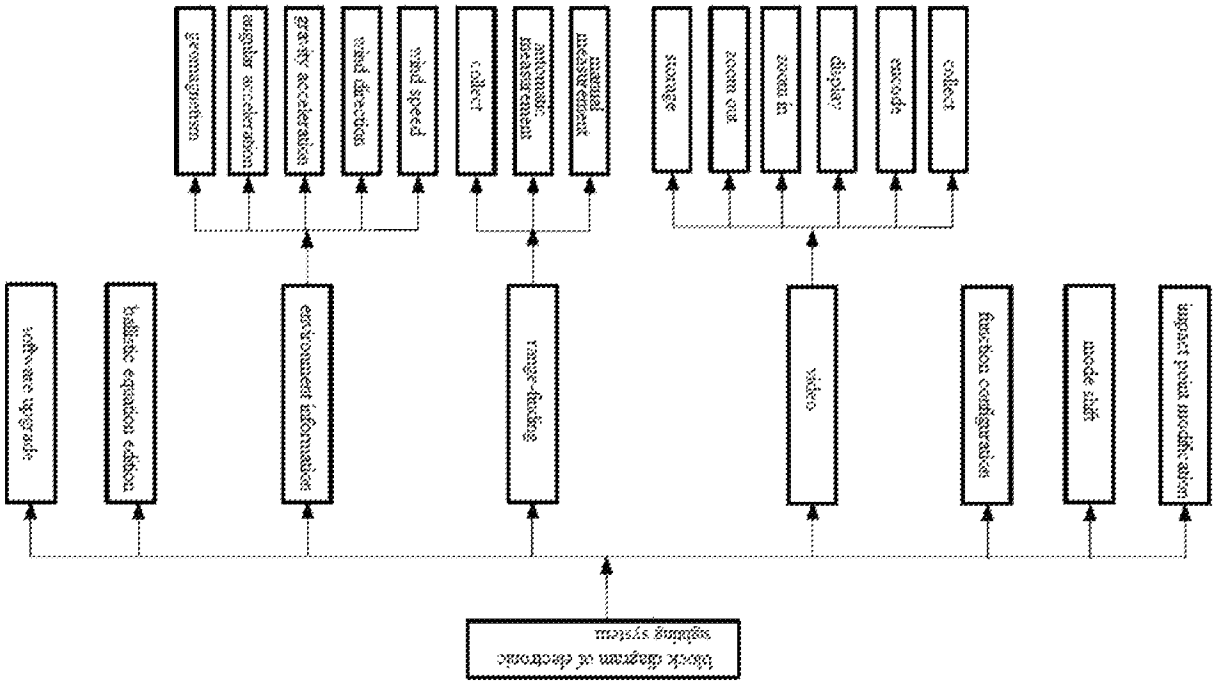
FIG. 7 shows a system block diagram of a photoelectric sighting system in an embodiment of the present invention.
Figure 8:
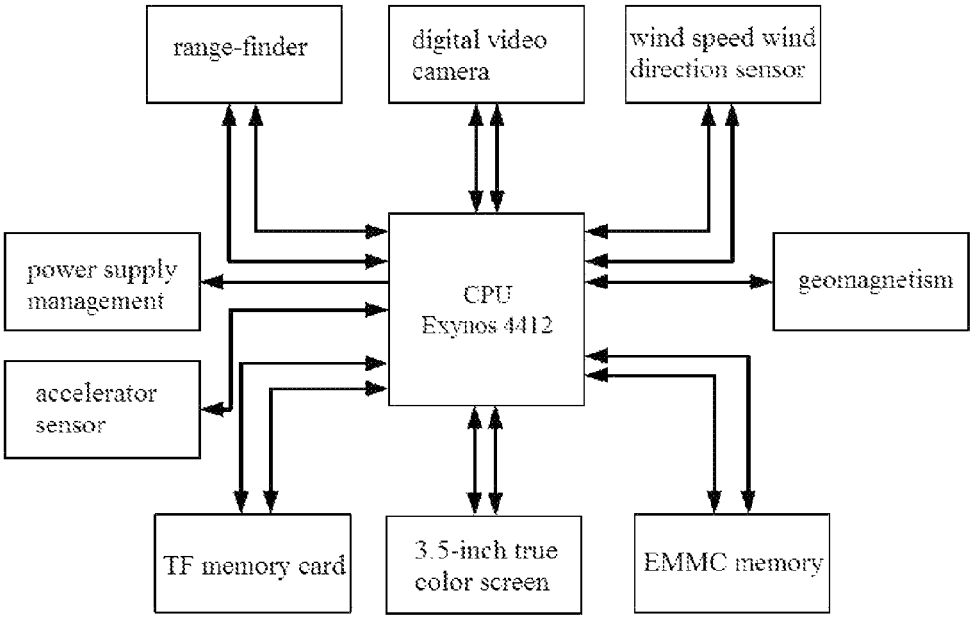
FIG. 8 shows a structural diagram of a sensor assembly of a photoelectric sighting system in an embodiment of the present invention.
Figure 9:
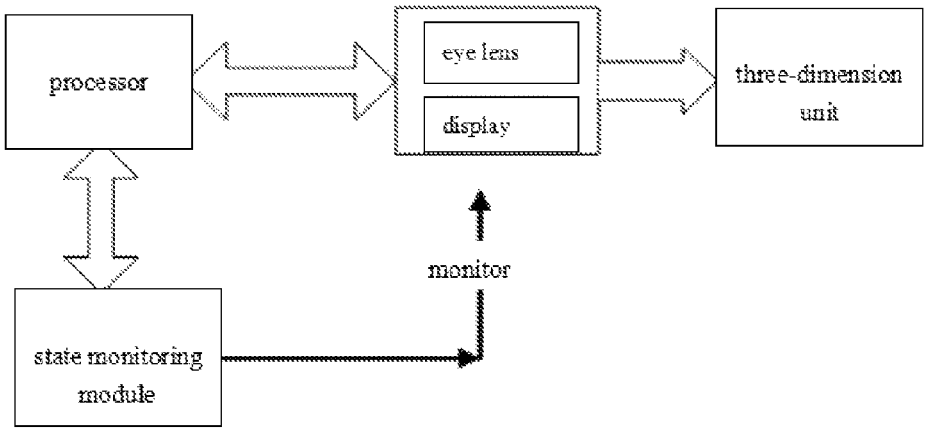
FIG. 9 shows a work diagram of a display unit of an electrical-optical sighting system in an embodiment of the present invention.
Figure 10:
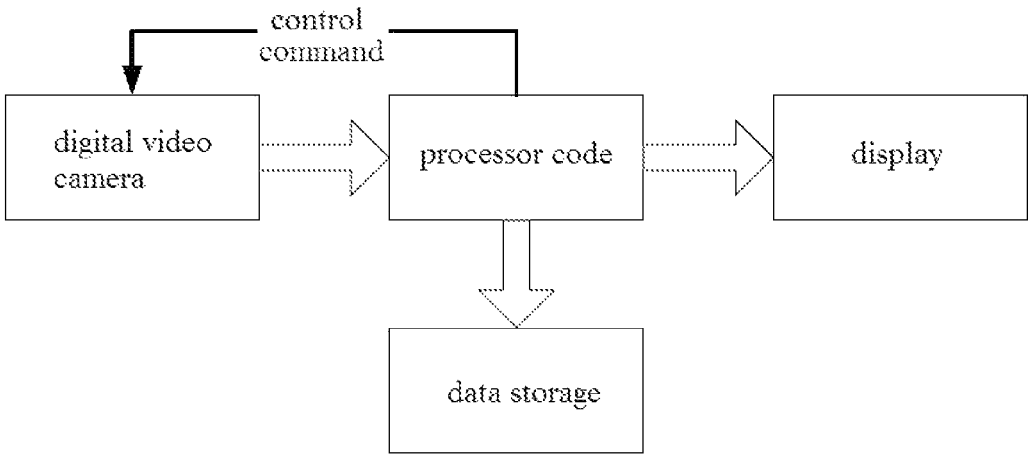
FIG. 10 shows a system diagram of field-of-view obtaining, storage, and feedback control of a photoelectric sighting system in an embodiment of the present invention.
Figure 11:
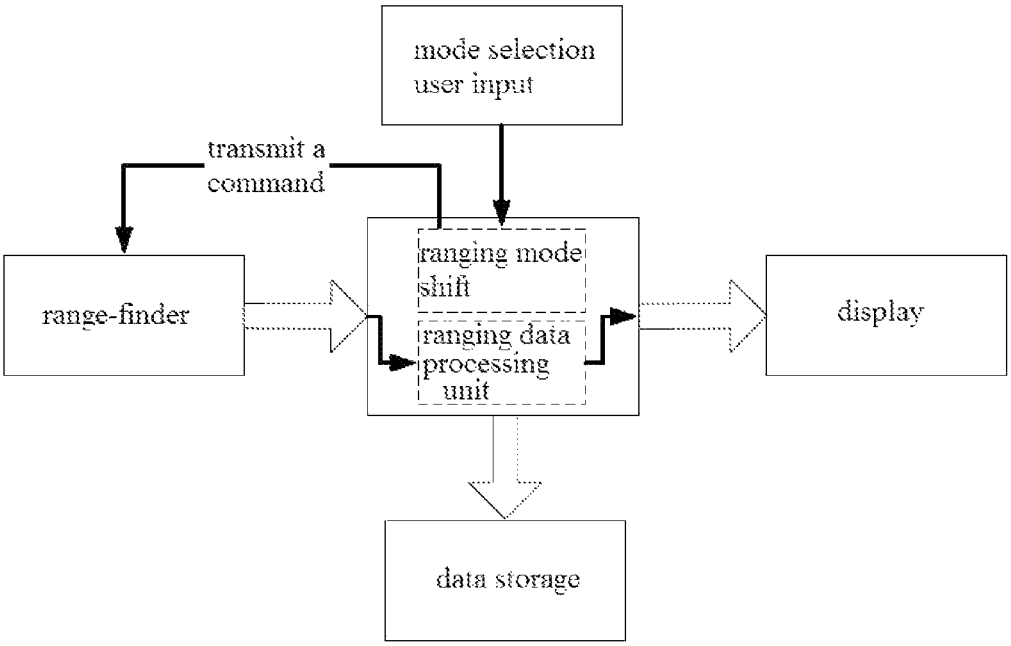
FIG. 11 shows a work diagram of a range-finder of an electrical-optical sighting system in an embodiment of the present invention.
Figure 12:
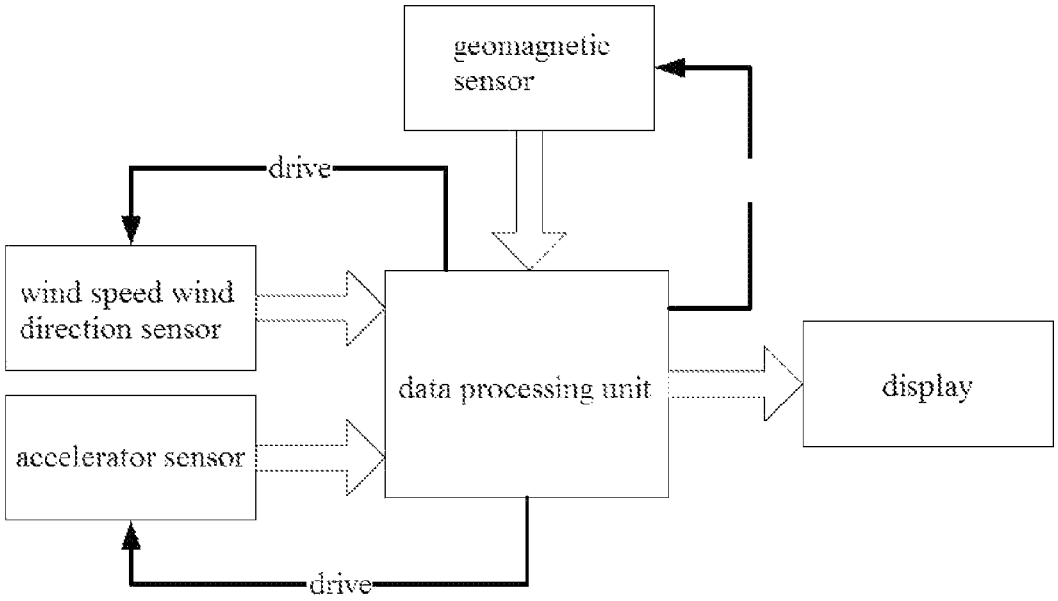
FIG. 12 shows a work diagram of a sensor assembly of a photoelectric sighting system in an embodiment of the present invention.

As shown in FIGS. 7 and 8, the photoelectric sighting system further comprises a plurality of sensors, specifically several or all of an acceleration sensor, a wind speed wind direction sensor, a geomagnetic sensor, a temperature sensor, a barometric sensor, a humidity sensor (obtaining different sensor data based on the selected ballistic equation). In one embodiment, the acceleration sensor and the geomagnetic sensor are integrated on the CPU core board 41. The acceleration sensor is a chip MPU-6050 integrating a gyro and an acceleration meter; the geomagnetic sensor is a three-axis magnetometer MAG3110; the wind speed wind direction sensor is disposed external to the photoelectric sighting system and connected onto the interface board 42. The temperature sensor, barometric sensor, and humidity sensor may be integrated on the CPU core board or connected onto the CPU core board through the interface board 42. All of the above sensors employ a 11C (or 12C, $I^2C$) interface.

Within the housing 1 is also disposed a battery compartment 12. Within the battery compartment 12 is provided a battery assembly 43, within the battery compartment 12 is provided a slideway for plugging the battery assembly 43 in and out. The battery compartment 12 is disposed at a middle bottom side within the housing 1. Through a side edge of the housing 1, a battery compartment cover may be opened to change the battery assembly 43. In order to prevent slight deviation in battery size of the same model, a layer of sponge (or foam, bubble cotton) is provided at the internal side of the battery compartment cover. The sponge structure disposed at the internal side of the battery compartment cover may also prevent battery instability caused by shock from gun shooting.

A battery circuit board is provided at an upper side of the battery assembly 43. The battery assembly 43 supplies power to various elements of the photoelectric sighting system through the battery circuit board, and meanwhile the battery circuit board is connected to the CPU core board 41 via the interface board 42.

In one embodiment, the battery assembly 43 specifically employs a voltage of 7.2-7.4V; a capacity of 3900-5700 mAh; an electrical work of 28.08 Wh-42.2 Wh; and a weight of 100-152 g.

An external key 114 is provide at the external side of the housing 1 close to the display unit 21. The external key 114 is connected on the socket board 42 via a key control board at the internal side of the housing 1. By touching and pressing the external key 114, the information on the display unit 21 may be controlled, selected and modified. The specific position of the external key 114 is 5-10 cm away from the display unit.

The external key 114 is specifically disposed to the right of the display unit. However, the specific position of the external key 114 is not limited to the above position. Instead, it should be disposed at a position facilitating the user to use and press. The user controls the CPU core board 41 through the external key 114. The CPU core board 41 drives the display screen to display. The external key 114 may control selection of a shooting target in a view zone displayed on the display unit, or control the photoelectric sighting system to start a laser range-finder, or control a video camera unit of the photoelectric sighting system to regulate the focal distance of the gun sight, etc.

In another embodiment, the key control board for the external key 114 may be provided with a wireless connection unit, through which peripheral devices are connected. The periphery devices include a smart phone, a tablet computer, etc. then, program is loaded through the periphery devices, which may control selection of a shooting target in a view zone displayed on the display unit, or control the photoelectric sighting system to start a laser range-finder, or control a video camera unit of the photoelectric sighting system to regulate the focal distance of the gun sight, etc.

At the external side of the housing 1 is further provided an external slot 111. A portion of the external slot 111 disposed at the internal side of the housing is connected to the key control board. A portion of the external slot 111 disposed at the external side of the housing is connected to an external connection line 112. The external connection line 112 is connected to an external key 113 through which the user may control selection of a shooting target in a view zone displayed on the display unit 21, or control the photoelectric sighting system to start a laser range-finder, or control a video camera unit of the photoelectric sighting system to regulate the focal distance of the gun sight, etc.

The external connection line 112 may also be connected to other operating devices, or ancillary shooting devices, or video display devices; or information and video may be transmitted through the external connection line 112. All of the other operating devices comprise an external control key, a smart phone, a tablet computer, etc. One end of the external connection line 112 is socketed within the external socket slot 111; the other end is provided with a "U"-shaped clip. The external connection line 112 is clipped on the gun barrel through the "U"-shaped clip, thereby securing the external connection line 112 and preventing affecting shooting. In one embodiment, an operating device connected through the external connecting line 112 may select a target in the view zone, start a laser range-finder, or adjust a gun sight focal distance, etc.; the "U"-shaped clip provide simple and convenient zooming and focusing operations for a gun without a support.

The display unit 21 is a LCD display. A touch operation may be implemented on the LCD display. The size of the display may be determined based on the actual needs. In the present invention, the display screen as adopted is sized to 3.5 inches.

In one embodiment, the LCD display screen has a resolution of 320*480, the work temperature is −20±70° C., the backlight voltage is 3.3 v, and the voltage between the LCD screen and the GPU interface is 1.8 v; the touch screen is a capacitive touch screen.

As shown in FIGS. 9, 10, 11, and 12, the reticle (front sight) displayed on the display screen and the video information collected by the field-of-sight obtaining unit are superimposed. The reticle is for sighting and shooting, while the display screen also displays ancillary shooting information for facilitating shooting and transmitted by various sensors above and work indication information;

The ancillary shooting information includes environment information, distance information, offset prompt information, and angle information;

The environment information includes wind speed data, temperature data, barometer data, and magnetic field data. The wind speed data is disposed at one end of the upper side of the display screen. The magnetic field data is disposed at a middle part of the lower side of the display screen. The temperature data and barometric data are disposed at the other end of the upper side of the display screen;

The distance information is disposed above the temperature data and barometric data;

the offset prompt information comprises offset direction data and offset distance data;

both the offset direction data and the offset distance data are located on the bottom-right side of the display screen.

The angle information includes the elevation angle data and azimuth angle data, where the elevation angle data is disposed beneath the wind speed data, while the azimuth angle data is disposed in the middle part of the upper side of the display screen.

The work indication information comprises battery level information, wireless signal information, remaining recording time, multiple information, shift key, and menu key;

The battery level information is disposed beneath the elevation angle data, while the remaining recording time, multiple information, and wireless signal information are disposed successively beneath the temperature data; the shift key and menu key are disposed at two ends of the lower side of the display screen.

The ancillary shooting information in the above embodiments are partially applied in a ballistic equation, and partially used for displaying to alert the user.

The photoelectric sighting system may also possibly comprise one or more ports and a radio transceiving unit. The one or more ports and radio transceiving unit may communicate with a smart phone or other terminal devices through a wired or wireless connection.

The other information includes Wi-Fi signal, battery, state shift key, menu key, remaining recording time, recording key, and current multiples. The LCD display screen provided by the present invention may perform shift between daylight/night work modes. The night work mode is implemented through infrared light compensation.

In another embodiment, the eye lens module 211 and the display screen module 212 display the same information in the respective field-of-view regions thereof, and the displayed information includes, but is not limited to, a cross-shaped reticle (or front sight), video information captured by the field-of-view obtaining unit, auxiliary shooting information and operation indicating information. In the present invention, the field-of-view region of the eye lens module 211 has a circular shape, and the field-of-view region of the display screen module 212 has a square shape, but the invention are not limited thereto.

The photoelectric sighting system may also comprise a wireless transmission module. The wireless transmission module is connected to an external device through a wireless connection manner. The wireless transmission module will synchronously display the reticle, image and information displayed on the display screen to the external device;

The wireless connection manner is a WiFi connection or other wireless network connection, but not limited to these connection manners. The external device is a smart phone or other intelligent terminal device, etc.

Based on the structure of the above photoelectric sighting system, its CPU core board 41 is further connected with a memory card. Within the memory card, bullet information database and two ballistic calculation model systems are set. The user may select one of the two ballistic models based on the setting of the sensor. The ballistic models are an external ballistic 6-degree-of-freedom rigidity model and a low trajectory ballistic model, respectively. Through the two ballistic models, the photoelectric sighting system realizes a precise positioning.

In order to accurately predict the position of an impact point, the impact point is predicted using an external ballistic 6-degree-of-freedom rigidity model based on the data collected by various sensors and the bulletin data stored in the memory.

When a shot is flying in the air, the force and torque acting on the shot are mainly the acting force from the earth and aerodynamic force. Generally, the motion of the shot may be decomposed into center of mass motion and motion around the center of mass, which are described by momentum law and law of moment of momentum.

In the 6-degree-of-freedom rigidity model, the shot in spatial movement is regarded as a rigidity. It considers three free degrees of the center of mass of the shot and three free degrees rotating around the center of mass. And all forces and torques acted on the shot are considered.

In the above model, the parameters that need to be input include: 1) atmospheric conditions: wind speed wind direction, temperature, air pressure, humidity; 2) shooting position: altitude and latitude, as well as elevation coordinates of the shooting point; 3) shooting condition: initial velocity and direction of the bullet outlet, wherein the direction is represented by the elevation angle and azimuth angle of the gun barrel; 3) bullet-target distance: obtained through a laser range-finder; 4) bullet data (stored in the database): mass of the shot, cross-section area of the shot, mass eccentricity (or rotational inertia), resistance coefficient, etc.

Figure 13:
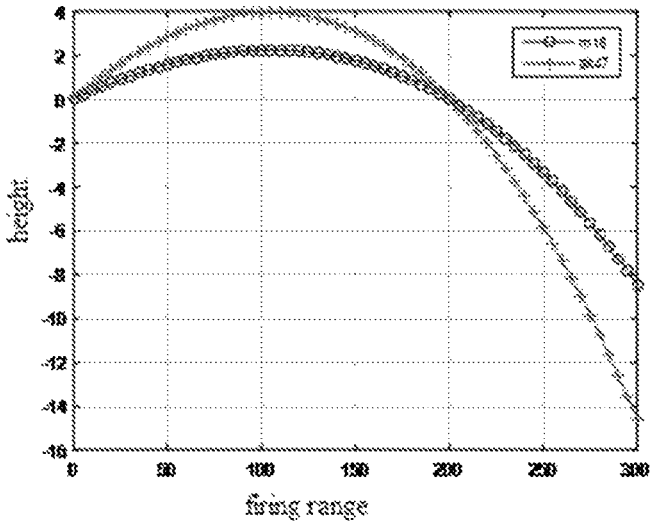
FIG. 13 shows a ballistic simulation comparison diagram for two shots by applying an external ballistic 6-degree-of-freedom rigidity model to a photoelectric sighting system in an embodiment of the present invention.
Figure 14:
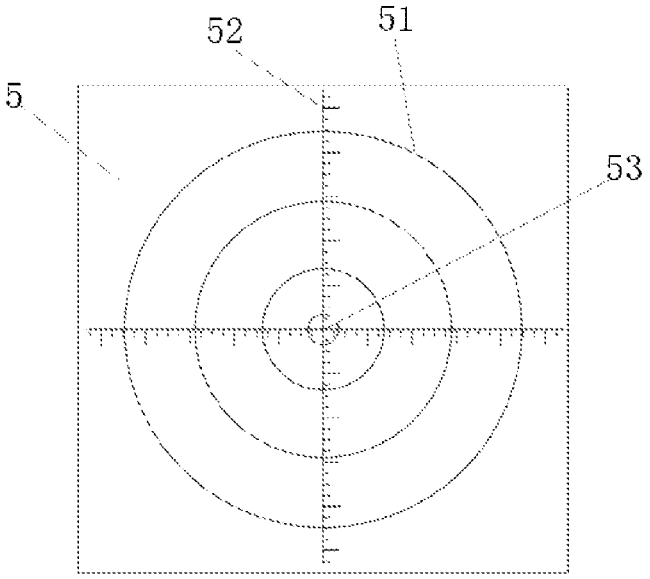
FIG. 14 shows a schematic diagram of a display screen before calibration in a photoelectric sighting system calibration method in an embodiment of the present invention.
Figure 15:
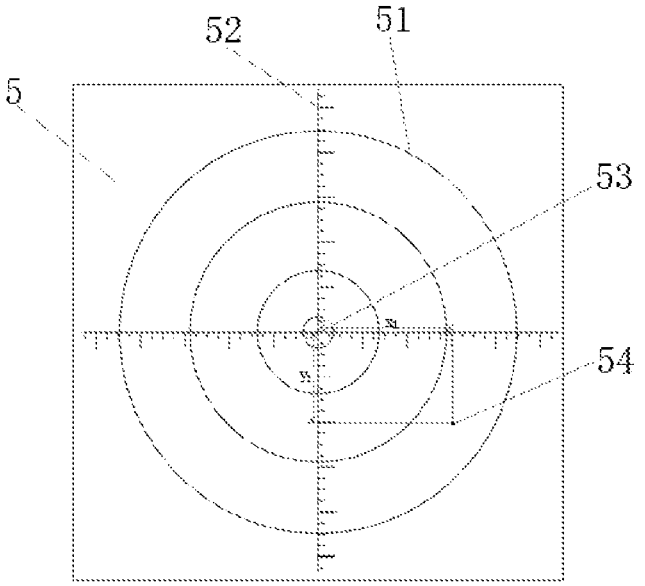
FIG. 15 shows a schematic diagram of a display screen having a first impact point in a photoelectric sighting system calibration method in an embodiment of the present invention.
Figure 16:
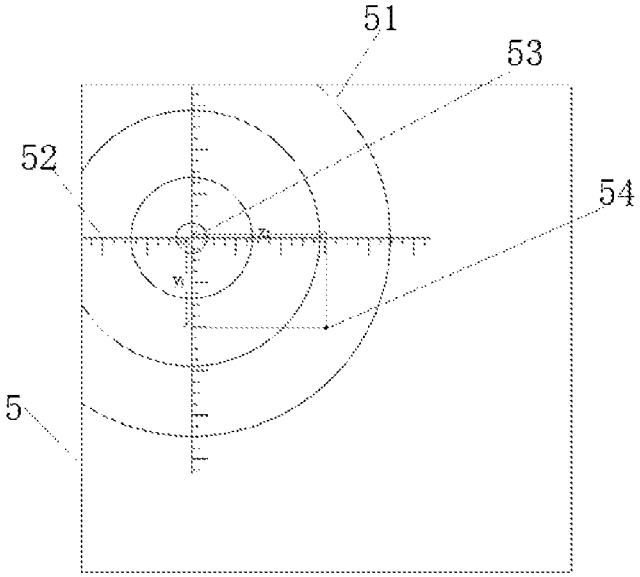
FIG. 16 shows a local enlarged view of FIG. 15 embodiment of the present invention.
Figure 17:
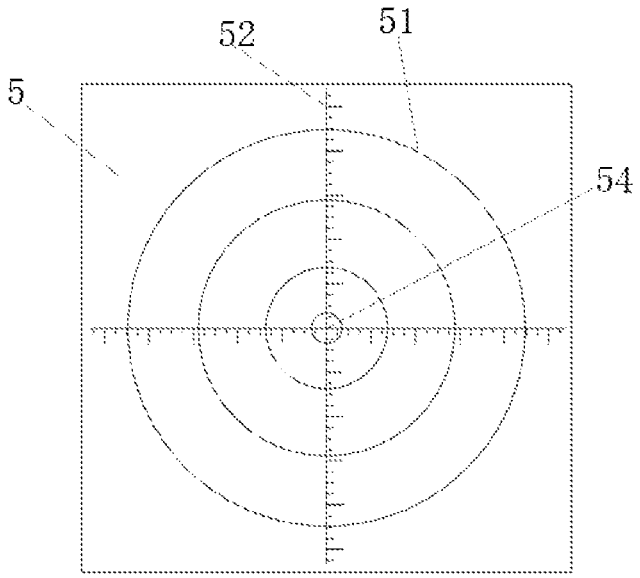
FIG. 17 shows a display screen diagram after a first shooting calibration in a photoelectric sighting system calibration method in an embodiment of the present invention.

FIG. 13 illustrates simulated calculations for a M16 233 Rem, 55 g, PSP shot and an AK47 (7.62×39 mm), 125 g, PSP shot. The simulation is performed only to vertical direction, and lateral direction is temporarily omitted. Supposed environment conditions: bullet-target distance 200 m, launching height 0.001 m, height 500 m, temperature 50 Fahrenheit degrees. It is seen from the figure that in order to shoot targets of a same distance, both initial launching heights are different; based on restriction conditions measured according to weather, the required launching height and launching direction are resolved; they may be regulated to hit a target at a certain distance.

In another scenario, if the wind force and wind speed are not high and the acting force of the lateral wind is very small, the low trajectory ballistic model is employed. In the low trajectory ballistic model, impacts from the low wind speed wind direction, temperature, air pressure, humidity might not be considered.

The low trajectory may be understood such that the arc variation of the bullet trajectory (i.e., parabola) approaches to a straight line. The closer to the straight line, the lower trajectory it is. Low trajectory ballistic calculation refers to ballistic calculation under a condition of small angle of fire; based on the feature that the resistance coefficient of a low-speed shot approximates a constant (specifically, for a low trajectory, under a standard weather condition, the air density function is approximately 1, the sound velocity is regarded as a constant; therefore, the resistance coefficient is a function of the bullet speed), external ballistic 6-degree-of-freedom basic equation may be simplified to resolve an equation of shooting elements of any point of the low-speed low trajectory, thereby finding a calculation method for resolving the shooting elements at the apex of the trajectory, the shooting elements at the impact point, and the point-blank range.

During the shooting process, some affecting objects (e.g., grass blown by wind) might exist to block the targeted object, thereby affecting the accuracy of the obtained range data. Therefore, in one embodiment, the laser range-finder of the photoelectric sighting system likely have a manual mode. The manual mode is specifically selecting a to-be-ranged target object on the display unit. The display unit feeds back the target object to the control unit. The control unit sets a flag to the target object and controls the laser range-finder to range the flagged target object. Only the range value of the flagged target object is read. Through the above manual ranging, the range value of the sighted object can be accurately measured, which avoids interference from other affecting objects. The control unit in the present embodiment is a CPU core board, or other unit or assembly that has an independent data processing capability.

A precise photoelectric sighting system is provided, and the precise photoelectric sighting system comprises an automatic simulated calibration and a manual calibration.

The automatic simulated calibration comprises steps of:

1. setting a target within a field of view of the photoelectric sighting system;

2. simulating a simulated impact point through one of the above ballistic models;

In the case of applying the external ballistic 6-degree-of-freedom rigidity model to simulate the impact point, collecting information of the range-finder, environment information and angle information of a plurality of sensors, bullet-related data stored in a memory card, thereby simulating the impact point;

In the case of applying the low trajectory ballistic model to simulate the impact point, under a standard weather condition, the air density constant is 1, the sound speed is a constant, the resistance coefficient is a function of bullet speed, thereby simulating the impact point;

3. watching the field of view of a display screen of the photoelectric sighting system, adjusting the reticle, and making the reticle on the display screen in coincidence with the simulated impact point;

4. accomplishing automatic simulation and calibration.

As shown in FIGS. 14-17, the manual calibration comprises steps of:

1. setting a target 51 within a field of view 5 of the photoelectric sighting system, and measuring a distance from the photoelectric sighting system to the target 51 through a laser range-finder of the photoelectric sighting system;

2. invoking a plane coordinate 52 through an external key, loading the plane coordinate 52 on the display screen, a coordinate center 53 of the plane coordinate 52 coinciding with a reticle center;

3. watching the field of view 5 of the display screen of the photoelectric sighting system, and making the coordinate center 53 of the plane coordinate 52 in alignment and coincidence with the target within the field of view;

4. after alignment and coincidence, shooting a first bullet, and obtaining a first impact point 54 on the target, the display screen print-screening an image of the first impact point 54;

5. recording values of horizontal coordinate and longitudinal coordinate of the first impact point in the plane coordinate, e.g., $x_1$, $y_1$, and regulating the field of view of the display screen of the photoelectric sighting system; moving the horizontal coordinate direction by $-x_1$; moving the longitudinal coordinate direction by $-y_1$, such that the coordinate center 53 of the plane coordinate 52 coincides with the first impact point;

6. accomplishing calibration.

Before the first calibration shooting in the above embodiment, it always occurs that the first shooting deviates greatly, and the impact point does not fall within the target in the field of view. In order to avoid occurrence of the above condition, it is proposed in one embodiment of the present invention that through a ballistic model in the above embodiment, performing simulated shooting to the target in the field of view in step 1 to find a simulated impact point; then, performing automatic simulation and calibration based on the simulated impact point; then possibly selecting the first shooting calibration. This may guarantee that the impact point of the first shooting falls on the target.

According to the calibration method provided in the present embodiment, the core controller real-time receives the environment values collected by sensors, the distance from the gun sight to the sighted object measured by the laser range-finder, and bullet information provided by the memory. The ballistic model calculates a ballistic curve of the bullet based on the real-time varied environment values, consecutive non-discrete distance information, and bullet information, thereby obtaining a simulated impact point, and real-time applies the calculated impact point to determine and regulate a reticle, such that when the photoelectric sighting system sights any sighted object at a consecutive non-discrete distance under any environment, the reticle can be regulated in real time based on a ballistic curve calculation model, such that the reticle center is close to the actual impact point, thereby achieving an effect of non-polar reticle.

In one embodiment, after the first calibration shooting is completed, in order to further enhance the preciseness, a second shooting calibration may be performed, comprising steps of:

Steps 1-5 are identical to the above embodiment, thereby omitted here;

6. performing a second shooting to shoot a second bullet, obtaining a second impact point on the target, the display screen print-screening an image having the first impact point and the second impact point;

7. recording the numerical values of the horizontal coordinate and longitudinal coordinate of second impact point in the plane coordinate, e.g., $x_2$, $y_2$, and regulating the field of view of the display screen of the photoelectric sighting system; moving the horizontal coordinate direction by $-x_2$; moving the longitudinal coordinate direction by $-y_2$, such that the center of the plane coordinate coincides with the first impact point;

8. accomplishing calibration.

In one embodiment, the display screen print-screens an image by obtaining an instruction signal transmitted from the CPU core board, the memory card caches vibration parameters generated when a plurality of guns of various models shoot bullets. The vibration parameters may include: a vibration frequency, a vibration amplitude, and a vibration duration. The CPU core board may be connected to a sensor obtaining a vibration parameter. The sensor is a vibration sensor of a known technical kind. The obtained vibration parameters are matched with vibration parameters cached in the memory card. In the case of a successful match, it is confirmed as a shooting vibration; then the core control board sends a snapshot instruction signal to the display screen to control the display screen to snapshot.

The precise photoelectric sighting system provided by the present invention realizes accurate calibration under the current environment values by making the reticle in coincidence with the impact point through specific shooting.

The photoelectric sighting system is automatically calibrated after an initial preparation is finished.

Figure 18:
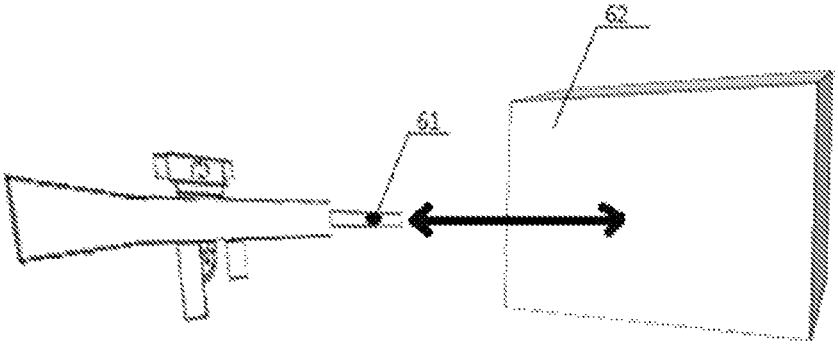
FIG. 18 is a schematic diagram illustrating operations of another automatic calibration method of the photoelectric sighting system according to an embodiment of the present invention.
Figure 19:
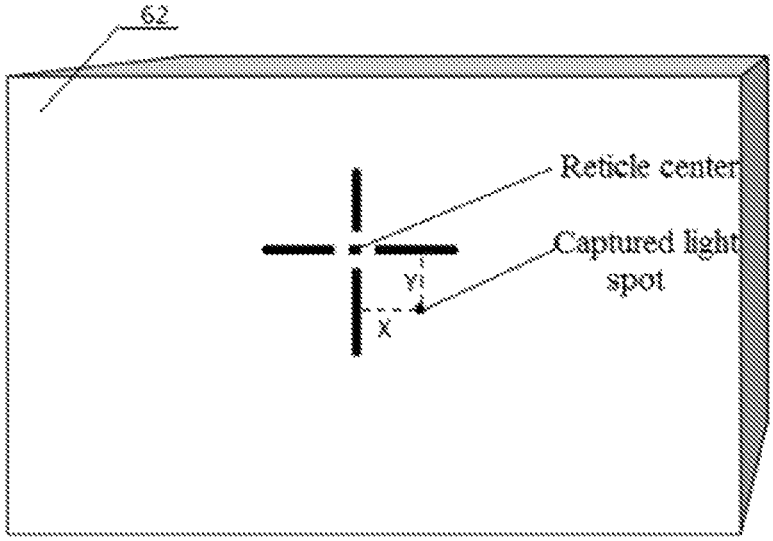
FIG. 19 is a schematic diagram showing a display screen in another automatic calibration method of the photoelectric sighting system according to an embodiment of the present invention.

As shown in FIGS. 18 and 19, the automatic calibration comprises steps of:

1. placing a reflection plate 62 at a distance of 5-50 m right ahead of a gun installed with the photoelectric sighting system;

2. setting a light-emitting device 61 in a gun bore of the gun;

3. selecting an automatic calibration mode by a shooter starting the field-of-view regulating unit or touching a display screen;

emitting a beam of light from the gun bore of the gun, where the light is transmitted to the reflection plate 62 and then reflected to the photoelectric sighting system; automatically capturing the reflected light by the optical sensor assembly in the photoelectric sighting system, encoding the information of the light into optical data, and transmitting the optical data by the sighting circuit unit to the processor on the CPU core board 41; processing the optical data by the processor, and transmitting the processed optical data to the display unit 21; displaying a light spot corresponding to the reflection plate 62 by the display unit 21; performing image recognition processing on the light spot displayed by the display unit by the sighting circuit unit in the photoelectric sighting system, calculating position data of the light spot, and further calculating offset data of the position data of the light spot relative to a center of the reticle 53 of the display unit; and automatically performing image offset processing by the sighting circuit unit according to the offset data, and recording an offset value; and 4. accomplishing the automatic calibration.

With the calibration method of the photoelectric sighting system provided by the invention, the optical data based on the light-emitting device in the gun bore allows the reticle to be in coincidence with the impact point, thereby realizing automatic and precise calibration under current environment values.

As shown in FIGS. 20 and 21, for the precise photoelectric sighting system which allows for easy calibration, when performing sighting and locking operations on a target before shooting, the photoelectric sighting system obtains a real impact point at the current distance and a distance between the real impact point and a target marked point according to a calculation result of a built-in ballistic equation, here, the target marked point is set manually or automatically by the photoelectric sighting system to be a fatal point of a target prey, such as neck or heart.

The photoelectric sighting system displays the real impact point on the display unit 21, and obtains real offset pixels from the real impact point to the reticle. Because the reticle is located at the center of the screen, according to the direction of the offset pixels, the image is shifted in a direction opposite to the direction of the offset pixels in aligning the real impact point with the reticle.

When the ballistic calculation result indicates that there is a relatively significant distance between the real impact point and the target marked point, the shifted image might exceed the display region of the display unit, and under this condition, the photoelectric sighting system performs the locking operation on the fatal point of the target, and an indication frame for indicating an offset direction 71 and an offset distance 72 is popped up at the bottom right corner of the display region, so that the user may adjust the shooting direction according to the offset direction and the offset distance in the indication frame, where the offset direction and the offset distance in the indication frame will be updated in real time according to the movement of the image during the adjustment. When the offset distance is smaller than a threshold value, the offset direction and the offset distance in the indication frame are set to zero.

With the automatic target observing and tracing method of the photoelectric sighting system proposed in the invention, real-time calculation of the built-in ballistic equation is performed so that real-time impact points are continuously displayed as the user moves, and the processor prompts the user in real time about a movement direction and distance for shooting according to a distance between an impact point and a target sighting point, thereby realizing real-time observing and tracing of the target under the present environment value.

The invention claimed is:

1. A precise photoelectric sighting system, comprising:

a field-of-view obtaining unit configured to obtain image information within a field of view for sighting;

a display unit configured to display a reticle, an icon and the image information obtained by the field-of-view obtaining unit;

a three-dimension unit configured to convert the reticle, the icon and the image information obtained by the field-of-view obtaining unit, which are displayed on the display unit, from a two-dimension image into a three-dimension image;

a sighting circuit unit configured to transmit the image information from the field-of-view obtaining unit to the display unit, and precisely predict sighting;

a power supply configured to supply power to the photoelectric sighting system; and a housing, wherein the housing as a whole is of a detachable structure, the housing includes an internal accommodation space, and the field-of-view obtaining unit, the display unit, the power supply, and the sighting circuit unit are all disposed within the same accommodation space.

2. The precise photoelectric sighting system of claim 1, wherein the display unit comprises an eye lens module, a display screen module, and a state monitoring module for monitoring a position state of the display screen module at any time;

the display unit is configured to switch a display mode according to a state of the display screen module, and the display screen module allows for two-eye observing and sighting, wherein the display unit is disposed at a rear end of the housing, with the eye lens module being disposed at the rearmost end of the housing and the display screen module being disposed on any side of the rear end of the housing.

3. The precise photoelectric sighting system of claim 1, wherein the three-dimension unit is in detachable connection with the housing and is arranged at front of the display screen in the display screen module.

4. The precise photoelectric sighting system of claim 1, further comprising:

a range-finding unit configured to measure a distance from a sighted object to the photoelectric sighting system;

wherein the range-finding unit is disposed within the same accommodation space in the housing, or is hand-held, or is affixed to an exterior surface of the housing.

5. The precise photoelectric sighting system of claim 4, wherein the range-finding unit comprises a signal emitting end and a signal receiving end; and the field-of-view obtaining unit comprises an optical image obtaining end; wherein the signal emitting end, the signal receiving end, and the optical image obtaining end are disposed at the front end of the housing, and the display unit is disposed at the rear end of the housing.

6. The precise photoelectric sighting system of claim 5, wherein the signal emitting end and the signal receiving end are disposed at an upper end or a lower end of the optical image obtaining end.

7. The precise photoelectric sighting system of claim 6, wherein a protection unit is disposed at the front end of the housing.

8. The precise photoelectric sighting system of claim 1, wherein the sighting circuit unit is further integrated with a plurality of sensors.

9. The precise photoelectric sighting system of claim 8, wherein each of the plurality of sensors is selected from the group consisting of an acceleration sensor, a wind speed and direction sensor, a geomagnetic sensor, a temperature sensor, a barometric sensor, a humidity sensor, a vibration sensor, and a position monitoring sensor.

10. The precise photoelectric sighting system of claim 1, further comprising two field-of-view regulating units, one of which is disposed on the display unit, and the other of which is disposed on the housing.

11. The precise photoelectric sighting system of claim 10, wherein the field-of-view regulating unit disposed on the display unit is configured to regulate the field of view via a touch display screen, and the field-of-view regulating unit disposed on the housing includes external keys.

12. The precise photoelectric sighting system of claim 10, wherein the display unit is configured to further display auxiliary shooting information and operation indicating information, with types and arrangement manner of the information being settable as desired by a user.

13. The precise photoelectric sighting system of claim 12, wherein the auxiliary shooting information comprises offset prompt information, environment information, distance information, and angle information, wherein the offset prompt information comprises offset direction data and offset distance data; the environment information comprises wind speed data, temperature data, barometric data, and magnetic field data; and the angle information comprises elevation angle data and azimuth angle data.

14. The precise photoelectric sighting system of claim 13, wherein the operation indicating information comprises battery level information, wireless signal information, remaining recording time, zoom ratio information, switching key and menu key.

15. The precise photoelectric sighting system of claim 14, further comprising a wireless transmission module, which is connected to an external device in a wireless connection manner and is configured to synchronously display, on the external device, the reticle, the image and the information displayed on a display screen;

wherein the wireless connection manner is a WiFi connection or other wireless network connection manner, and the external device is a smart phone or other intelligent terminal device.

16. The precise photoelectric sighting system of claim 8, wherein the sighting circuit unit comprises an interface board and a core board; a field-of-view driving circuit of the field-of-view obtaining unit, a range-finding control circuit in the range-finding unit, a key control circuit of the key unit, and a battery control circuit of the battery module are connected to the core board through the interface board; and a display driving circuit of the display unit and a WiFi driving circuit of the wireless transmission module are connected to the core board.

17. The precise photoelectric sighting system of claim 16, wherein a memory card is inserted into the core board, and a bullet information database and two ballistic calculation models are preset in the memory card, so that a user is allowed for selection from the two ballistic calculation models based on settings of the sensor, and wherein the two ballistic calculation models include an external ballistic 6-degree-of-freedom rigidity model and a low trajectory ballistic model.

18. The precise photoelectric sighting system of claim 1, characterized by automatic calibration after performing initial preparation.

19. The precise photoelectric sighting system of claim 18, wherein the automatic calibration comprises steps of:

A) placing a reflection plate at a certain distance right ahead of a gun installed with the photoelectric sighting system;

B) setting a light-emitting device in a gun bore of the gun;

C) selecting an automatic calibration mode by a shooter starting the field-of-view regulating unit or touching a display screen;

D) emitting light by the light-emitting device, wherein the light is reflected by the reflection plate and is captured by an optical sensor of the photoelectric sighting system, and the optical sensor encodes light information into optical data, which is processed by the sighting circuit unit and then transmitted to the display unit to be displayed as a light spot;

E) performing analysis, by the sighting circuit unit, according to position data of the light spot, calculating offset relative to a center of the reticle, and automatically performing image offset processing, wherein the position data comprises a horizontal coordinate and a longitudinal coordinate; and F) accomplishing the automatic calibration.

20. The precise photoelectric sighting system of claim 19, wherein the light emitted from the light-emitting device comprises visible light and invisible light, the reflection plate is configured to reflect the visible light and the invisible light, and a color of the light spot on the display unit is settable according to user preferences.

21. The precise photoelectric sighting system of claim 19, wherein as the user moves, the display unit is configured to continuously display real-time impact points via real-time calculation of a built-in ballistic equation in the photoelectric sighting system; and the sighting circuit unit is configured to perform real-time calculation of a movement direction and a movement distance for precisely shooting according to a distance between a real-time impact point and a target sighting point and prompt the user in real time, to realize real-time observing and tracing of a target under the present environment value.

* * * * *